US008685522B2

(12) United States Patent
Marasco et al.

(10) Patent No.: US 8,685,522 B2
(45) Date of Patent: Apr. 1, 2014

(54) NON-SLIP SURFACE AND PROCESS FOR MAKING SAME

(75) Inventors: Albert Phillip Marasco, Clive, IA (US); Taylor Dale Huff, Polk City, IA (US)

(73) Assignee: Infonet Corporation, Altoona, IA (US)

( * ) Notice: Subject to any disclaimer, the term of this patent is extended or adjusted under 35 U.S.C. 154(b) by 249 days.

(21) Appl. No.: 13/209,950

(22) Filed: Aug. 15, 2011

(65) Prior Publication Data

US 2013/0045357 A1 Feb. 21, 2013

(51) Int. Cl.
*B32B 3/24* (2006.01)
*B21D 31/04* (2006.01)

(52) U.S. Cl.
USPC ..... 428/137; 29/6.1

(58) Field of Classification Search
USPC ..... 428/136; 29/6.1
See application file for complete search history.

(56) References Cited

U.S. PATENT DOCUMENTS

| | | | | |
|---|---|---|---|---|
| 3,258,380 | A * | 6/1966 | Fischer et al. | 156/207 |
| 4,151,895 | A | 5/1979 | Rasada | |
| 5,357,724 | A | 10/1994 | Sonoda | |
| 6,318,033 | B1 | 11/2001 | Birch | |
| 6,665,987 | B2 | 12/2003 | Eve | |
| 7,162,839 | B2 * | 1/2007 | Ohno et al. | 52/180 |
| 7,374,810 | B2 * | 5/2008 | Durney et al. | 428/136 |
| 2004/0074698 | A1 | 4/2004 | Lawrence | |
| 2006/0230693 | A1 | 10/2006 | Giordano | |
| 2009/0277104 | A1 | 11/2009 | McCool | |

* cited by examiner

*Primary Examiner* — William P Watkins, III
(74) *Attorney, Agent, or Firm* — Brick Gentry PC; Brian J. Laurenzo; Jessica L. Susie

(57) ABSTRACT

A non-slip surface is provided comprising a surface having at least one arcuate lug, said arcuate lug comprising a raised center portion and raised and twisted side portions for preventing slippage. Additionally, a process is provided comprising the steps of cutting an arc into a surface, raising and twisting said arc in relation to said surface by bending said surface along a secant perpendicular to a line connecting the midpoint of said arc and the secant, creating at least one arcuate lug in said surface.

23 Claims, 6 Drawing Sheets

NON-SLIP SURFACE AND PROCESS FOR MAKING SAME

FIELD OF THE INVENTION

The present invention relates to non-slip surfaces. More specifically, the present invention relates to a surface having at least one arcuate lug and a process for making same.

BACKGROUND

Slippery surfaces have endangered mankind for centuries. Some surfaces, such as the surface of a step, may become especially slippery and may lead to serious injuries such as broken bones or even death. Additionally, dark and dirty surfaces can increase the likelihood of slippage. Several solutions have been attempted to solve the problems associated with a slippery surface. One such solution is to apply a non-slip material, such as adhesive backed anti-slip tape, to the surface. However, the utilization of the additional non-slip material has considerable drawbacks. The additional material has to be applied to the surface, the added coarse surface is difficult to clean, and the additional material wears down over time. Furthermore, the non-slip material may not actually cover the edge of the surface, allowing the edge of the surface to remain slippery. Applying a granular material onto a slick or slippery surface has been attempted, but the surface is harsh on bare skin and difficult to clean. Furthermore, the application of a granular material may be costly.

U.S. Pat. No. 4,151,895 discloses an attempt to solve the problems associated with a slippery surface by forming sharp horizontal corrugations along the surface of a step. Although the sharp horizontal corrugations wrap around the step, sideways slipping still occurs along the horizontal corrugations. Some plank grated steps provide slip resistance on the horizontal surface, but fail to provide slip resistance along the corner or edge of the step. Additionally, some plank grated steps have serrated openings which are harsh on bare skin. The previous attempts by others, such as U.S. Pat. No. 6,665,987, which shows the application of a granular material, fails to provide adequate slip resistance on the surface, especially along the corner, or edge, of the surface. Additionally, the previous attempts are harsh on bare skin, difficult to clean, and may be expensive to implement. Furthermore, the previous attempts have failed to orient and locate the means of slip resistance for optimal performance.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

When gripping, walking, or contacting a surface there is the possibility that a surface will be slippery. The following provides a solution to the problem of the slippery surface. The solution is to turn the slippery surface into a non-slip surface by cutting an arc in the surface and bending the surface to create one or more arcuate lugs in the surface. As a specific example, when walking up or down steps, people naturally place the sole of the shoe or bare foot upon the leading or front edge of the step. Without a special treatment to this edge, conditions may exist which facilitate slippage and may result in injury. The problem of the slippery surface is addressed by forming one or more arcuate lugs in the step surface. The arcuate lug may be located along the edge of the step so that the raised and twisted surface of the arcuate lug is square to the direction of potential slippage. The arcuate lug is effectively wrapped around the corner of the step in multiple instances along the length of the step edge. In the preferred embodiment, a laser is used to cut an arc of approximately 180 degrees by one half inch in radius in the surface of the step material. This process is repeated approximately one and one half inch, on center, along a straight line. Second, a ninety degree bend in the material is formed along the center line with an appropriate punch and die, raising and twisting the arc in relation to the surface of the step to form a series of arcuate lugs.

The arcuate lug that is created provides adequate slip resistance, does not damage bare skin, is easy to clean, and is economical to implement. Applications include any surface which may be slippery such as steps at a swimming pool, petroleum operations, or flour mill. In addition to steps, this feature can be incorporated into walking surfaces, such as decorative landscaping tiles, without adding material to the surfaces. Moreover, handles, hand rails, hand levers and similar objects may be enhanced by incorporating this non-slip feature. Furthermore, a light source placed near the arcuate lugs may emit light through the aperture around the arcuate lugs, illuminating the surface. The illumination of the surface may be attractive and improves safety.

BRIEF DESCRIPTION OF THE DRAWINGS

FIG. 1A illustrates the arcuate lug after the surface has been bent 90 degrees. The arcuate lug is slightly raised compared to the original surface. The side portions of the arcuate lug twist inwardly and toward the interior of the arcuate lug.

DETAILED DESCRIPTION

The following is a detailed description of the illustrated embodiments of surfaces containing an arcuate lug. For ease of discussion and understanding, the following detailed description and illustrations may refer to specific machinery, material, or surfaces. It should be appreciated that the specific machinery, material, or surfaces may be of any type, style, or arrangement, known or future developed, that would be advantageous to use in producing the arcuate lug or a non-slip surface. Additionally, recreational vehicle steps are discussed as the preferred embodiment; however, it should be appreciated that the steps or surfaces could be of any type suitable for the arcuate lug as described herein.

Figure 1A:
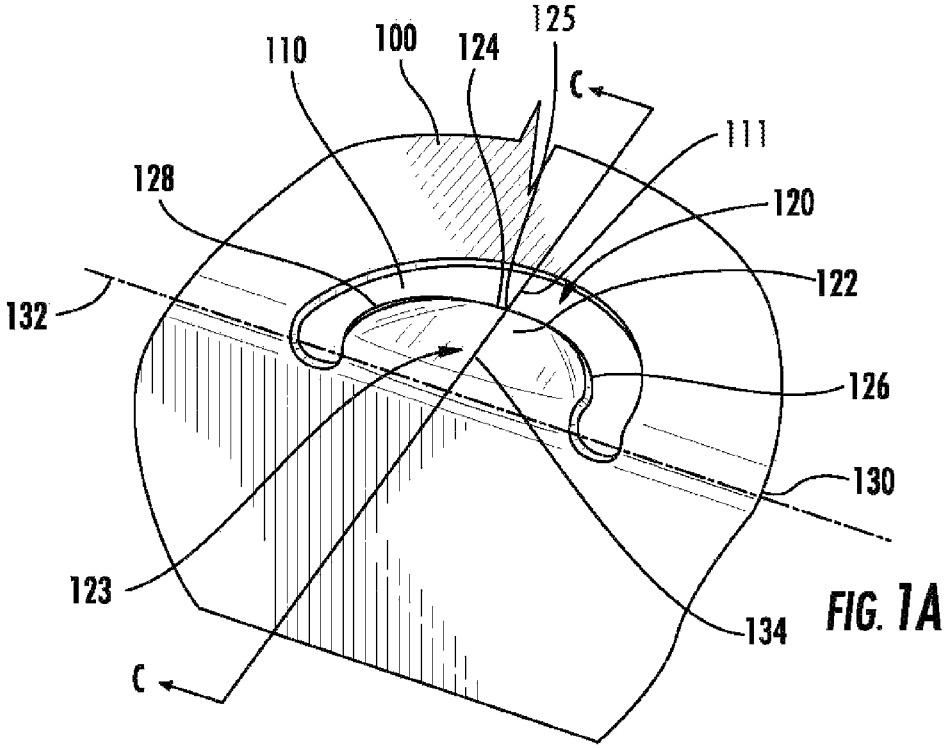
FIG. 1A is a perspective view of a surface containing an arcuate lug in accordance with the present invention.

FIG. 1A is a perspective view of a surface 100 with an arcuate lug 120. The surface 100 and the arcuate lug 120 may be made of any material that is capable of containing the arcuate lug 120 and accomplishing the purpose of the arcuate lug 120 including, but not limited to, metal, plastic, or wood. FIG. 1A illustrates the arcuate lug 120 which has been formed after an arc-shaped aperture 110 has been cut into the surface 100 and an approximately ninety (90) degree bend 130 has been made in the surface 100. The bending process, described in further detail below, causes the arcuate lug 120 to be raised and twisted in comparison to the original surface 100. In the preferred embodiment, the bend 130 in the surface 100 is approximately ninety (90) degrees, however, it is anticipated that the bend 130 in the surface 100 may be as little as one (1) degree. When the bend 130 is introduced to the surface 100 at least one arcuate lug 120 is created.

The arcuate lug 120 comprises a center portion 122 and right and left portions 126, 128. The center portion 122 is raised and the right and left portions 126, 128 are raised and twisted in comparison to the surface 100. In the preferred embodiment, the top surface 123 of the center portion 122 is saddle shaped or concave and the center 125 of the edge 124 may be nearly flush with the surface 100. Following the edge 124 of the arcuate lug 120 from the center 125 of the edge 124 of the arcute lug 120 to the right and left portions 126, 128, the right and left portions 126, 128 twist inwardly toward the top surface 123 of the arcuate lug 120. The right and left portions 126, 128 begin to twist where they meet the center portion 122 and continue to twist through the bend 130. The twist of the right and left portions 126, 128 may be very slight. The bend 130 is located along an aperture secant 132 passing through the right and left portions 126, 128. The secant 132 on which the surface 100 is bent is generally perpendicular to a line 134 connecting the center 125 of the edge 124, also referred to as the midpoint, to the secant 132 or perpendicular to a line 134 connecting the center 111 of the arc-shaped aperture 110 to the secant 132.

Generally, the arcuate lug 120 is blunt and will not irritate or puncture human skin. The raised and twisted arcuate lug 120 changes a potentially slick surface into a surface that will cause friction and therefore prevent slippage. The slipping problem is addressed by the forming of the raised and twisted arcuate lug 120 in the surface 100 so that the raised and twisted portions 126, 128 are square to the direction of potential slippage. In the preferred embodiment, the aperture 110 cut into the surface 100 may range from thirty (30) degrees to two hundred and seventy (270) degrees and, therefore, the edge 124 of the arcuate lug 120 may range from thirty (30) degrees to two hundred and seventy (270) degrees. It is anticipated that the aperture 110 may be shaped differently to create different variations of arcuate lugs 120. Additionally, it is anticipated that the arcuate lug 120 may have a ridged, waved, or other shaped edge capable of increasing friction along the surface 100. Furthermore, it is anticipated that the arcuate lug 120 may contain a series of smaller arcs along the edge 124 of the arcuate lug 120.

Figure 1B:
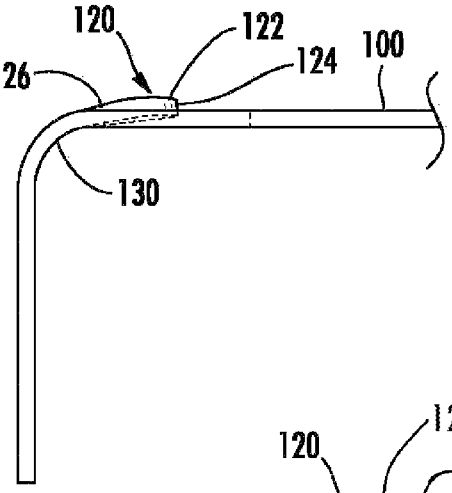
FIG. 1B is a side elevational view of the surface including the arcuate lug.
Figure 1C:
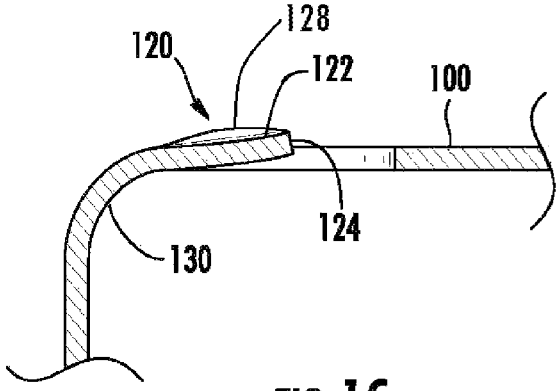
FIG. 1C is a sectional view of the arcuate lug shown along line C-C in FIG. 1A.

FIG. 1B is a side elevational view of the surface 100 including the arcuate lug 120 and illustrates the raised center portion 122 and the raised and twisted portion 126 of the arcuate lug 120 after the surface 100 has been bent approximately ninety (90) degrees. FIG. 1C is a sectional view of the arcuate lug 120 shown along line C-C of FIG. 1A. FIG. 1C illustrates half of the center portion 122, half of the edge 124 and the left portion 128 of the arcuate lug 120. Additionally, the bend 130 and the surface 100 are also disclosed in FIG. 1C. The arcuate lug 120 is effective against slippage in all directions but the primary utility is realized at slip angles perpendicular to the raised edge 124 of the arcuate lug 120.

Figure 2:
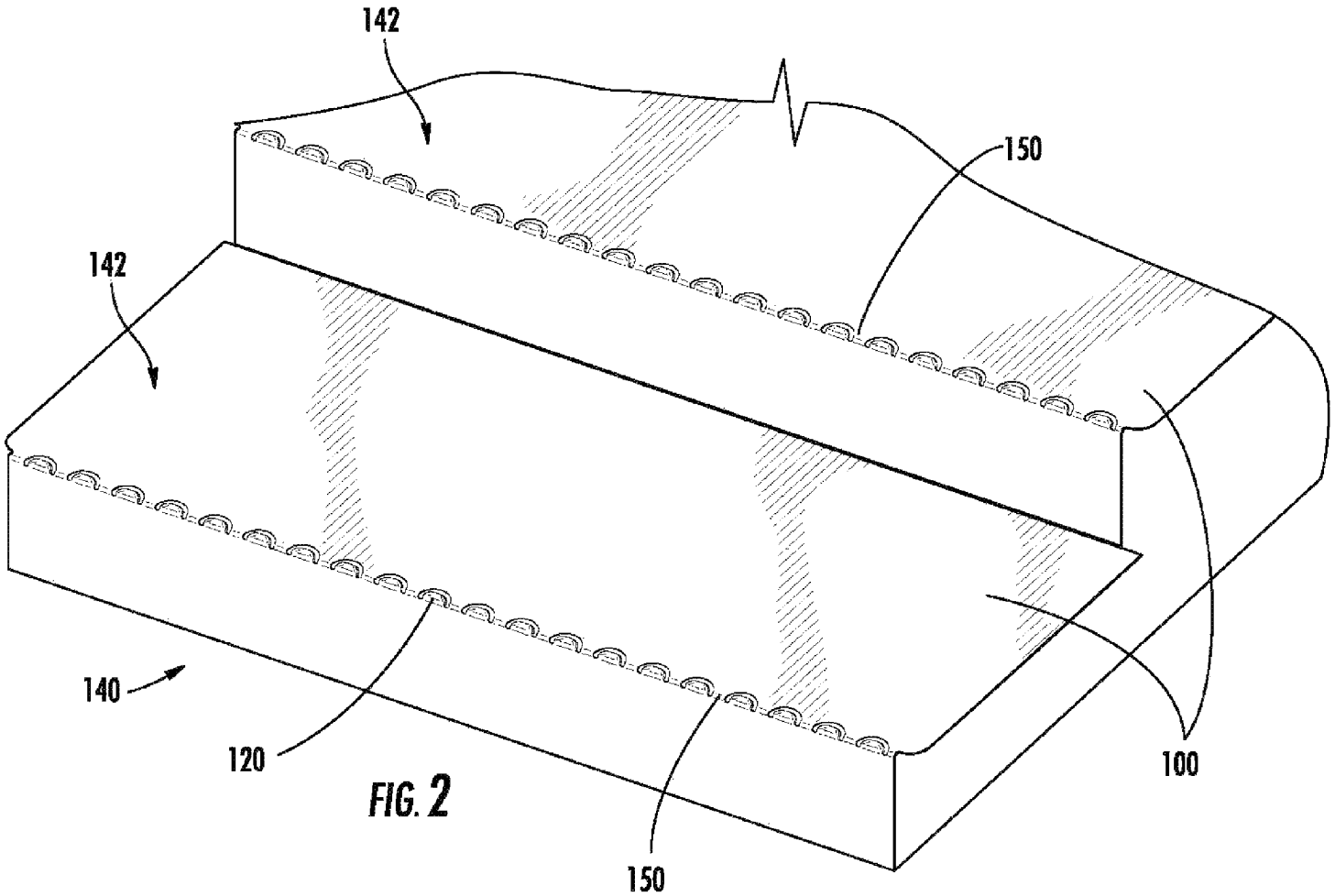
FIG. 2 is a perspective view of steps in accordance with the present invention illustrating a series of arcuate lugs along a leading edge thereof.

FIG. 2 is a perspective view of non-slip steps 140 with a series of arcuate lugs 142 along a leading edge 150 of the steps 140. Traditionally, the edges of steps are not treated or grated and remain slippery. The series of arcuate lugs 142 are comprised of individual arcuate lugs 120 repeated along the leading edges 150 of the surface of the steps 140. The twisted portions 126, 128 are effectively wrapped around the leading edges 150 of the steps 140 with multiple instances along the length of the leading edges 150 of the steps 140. In the preferred embodiment, the steps 140 are steps or step covers for a recreational vehicle and only the leading edges 150 contain the arcuate lug 120. It is anticipated that the steps 140 may have any type of surface used to support weight and that they may be made out of any material currently known or developed in the future. Additionally, it is anticipated that the arcuate lug 120 or series of arcuate lugs 142 may be located on any or all edges of any applicable surface. Furthermore, the figures only disclose two specific steps; however, one skilled in the art would understand that any number of steps or series of surfaces may contain the arcuate lug 120.

Figure 3:
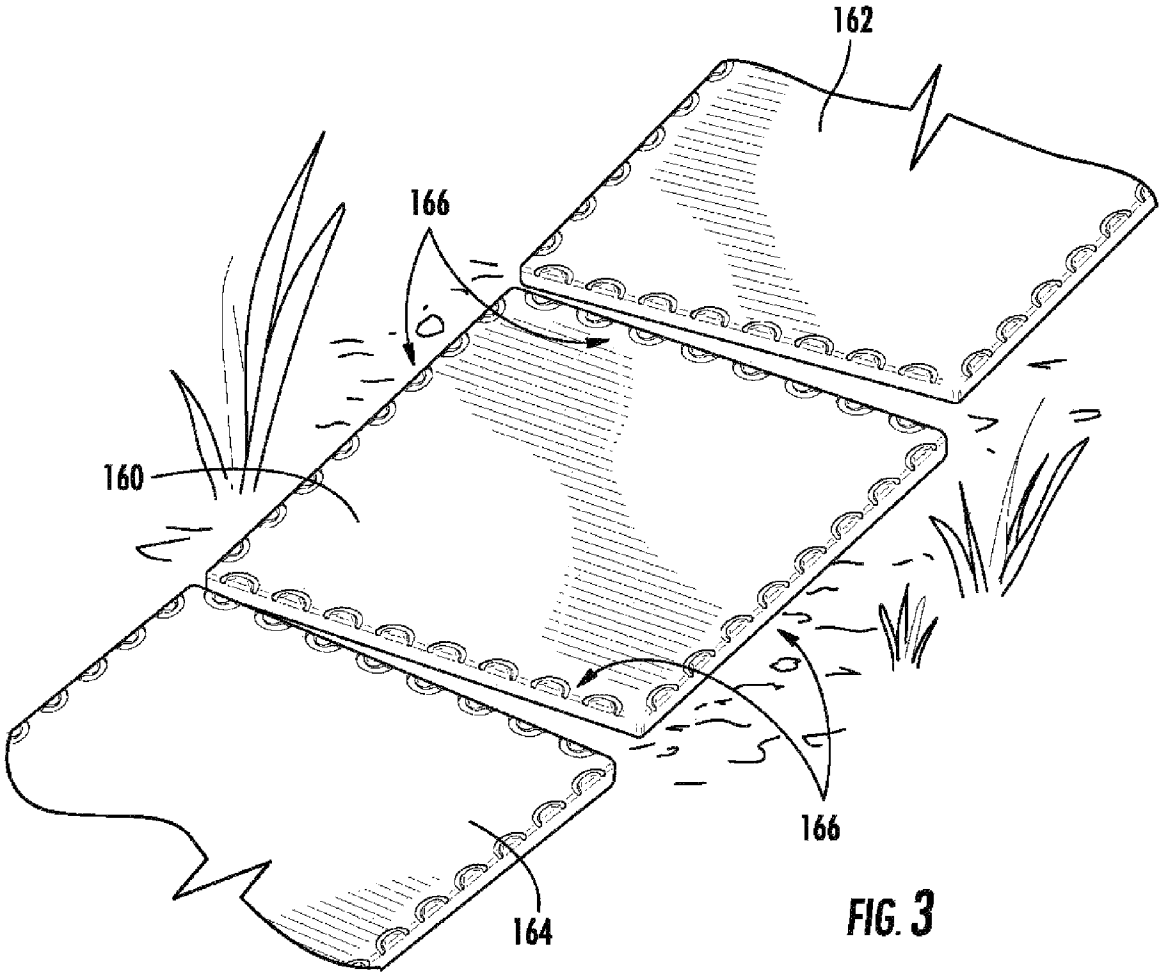
FIG. 3 is a perspective view of landscaping tiles in accordance with the present invention and illustrating a series of arcuate lugs along the edges thereof.

FIG. 3 illustrates tiles 160, 162, 164 containing multiple series of arcuate lugs 166. The series of arcuate lugs 166 have only been identified in the middle tile 160; however, they are clearly illustrated in the end tiles 162, 164. In the preferred embodiment, the tiles 160, 162, 164 are landscaping tiles to be walked upon. The tiles 160, 162, 164 may be made out of any material suitable for making tiles and comprising an arcuate lug. Three tiles 160, 162, 164 are illustrated; however, there may be any number or arrangement of tiles. Additionally, the tiles 160, 162, 164 comprise a series of arcuate lugs 166 on all of the top edges. It is anticipated that the tiles 160, 162, 164 may comprise only one arcuate lug or may comprise only one series of arcuate lugs and that the arcuate lug or series of lugs may be on any or all edges of any surface.

Figure 4:
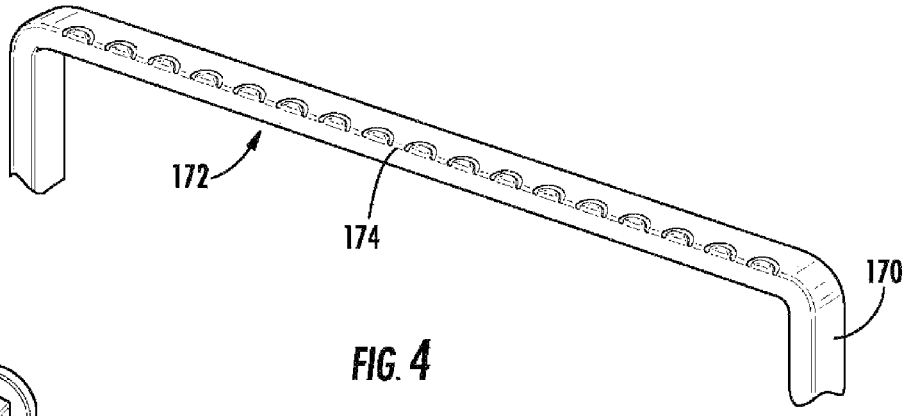
FIG. 4 is a perspective view of a handle in accordance with the present invention and illustrating a series of arcuate lugs along an edge thereof.
Figure 5:
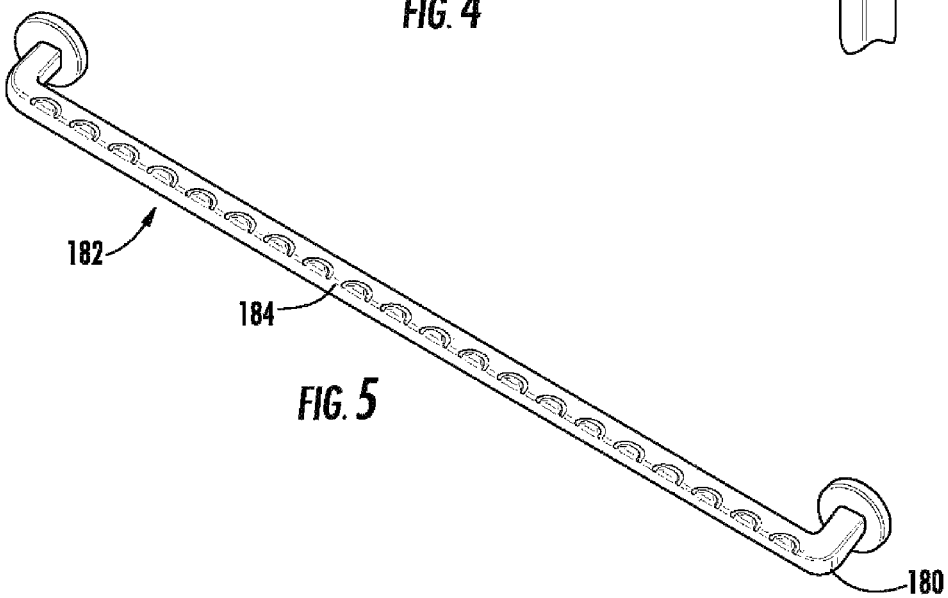
FIG. 5 is a perspective view of a hand rail in accordance with the present invention and illustrating a series of arcuate lugs along an edge thereof.
Figure 6:
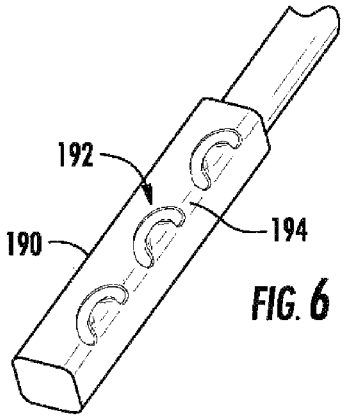
FIG. 6 is a perspective view of a hand lever in accordance with the present invention and illustrating a series of arcuate lugs along an edge thereof.

FIG. 4 is a perspective view of a handle 170 illustrating a series of arcuate lugs 172 along an edge 174 thereof. FIG. 5 is a perspective view of a hand rail 180 illustrating a series of arcuate lugs 182 along an edge 184 thereof. FIG. 6 is a perspective view of a hand lever 190 illustrating a series of arcuate lugs 192 along an edge 194 thereof. FIGS. 4, 5, and 6 illustrate different surfaces that are generally used for gripping. It is anticipated that handle 170, hand rail 180 and hand lever 190 may be of any type, style or arrangement and made out of any material suitable for comprising an arcuate lug. Additionally, it is anticipated that the surface of other objects used for gripping, such as a steering wheel, may comprise an arcuate lug in accordance with the present invention.

Figure 7:
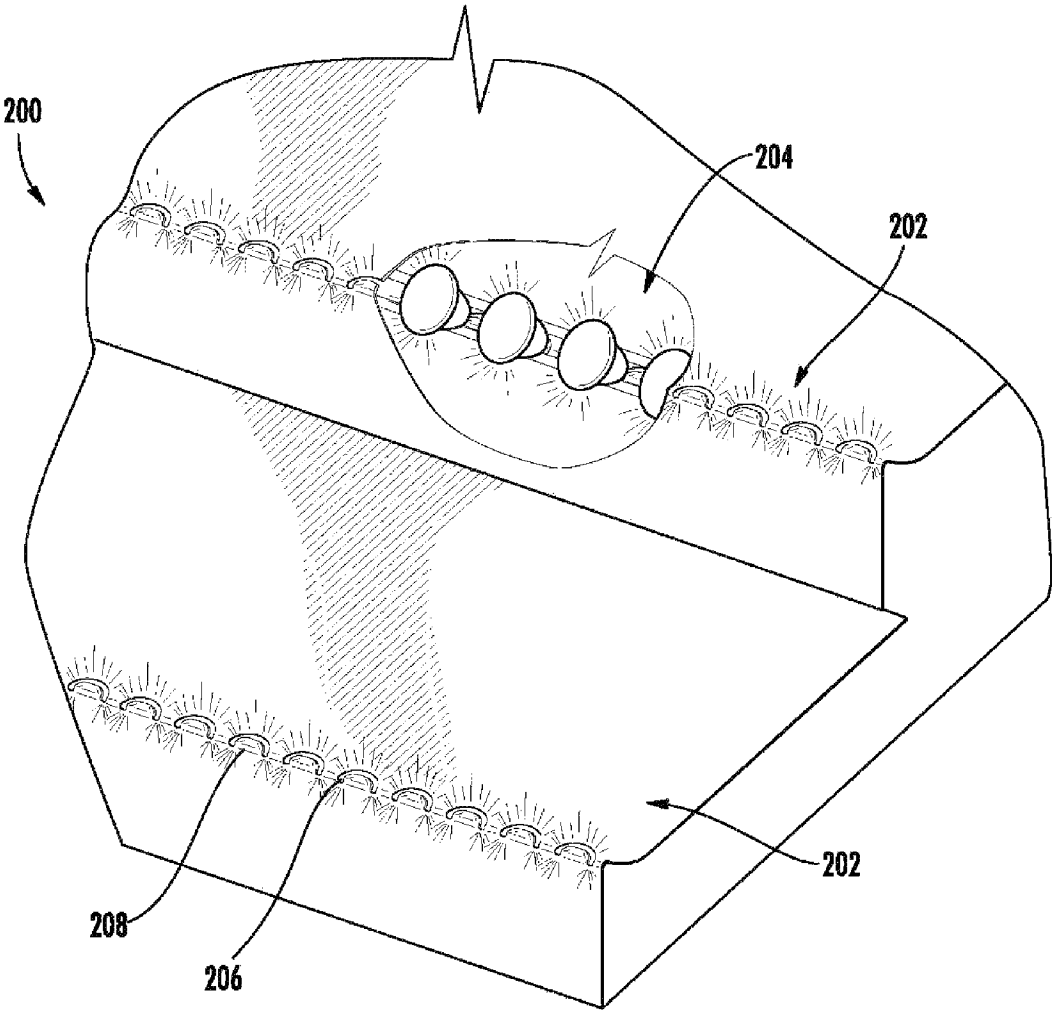
FIG. 7 is a cut-away perspective view of a series of multiple steps in accordance with the present invention and illustrating a light source emitting light from under the steps.

FIG. 7 is a cut-away perspective view of series of arcuate lugs 202 in multiple steps 200. Additionally, FIG. 7 illustrates a light source 204 emitting light from under the steps 200. The light then travels through the arc shaped apertures 206, illuminating the steps 200. The light source 204 is only illustrated with steps in FIG. 7, however, it is anticipated that a light source may be used with any surface containing an arcuate lug 208 and that the light source 204 may be any source of light currently known or developed in the future. Only two of the apertures 206 are identified in FIG. 7, however, the aperture 206 as illustrated may be included with every arcuate lug 208.

Figure 8A:
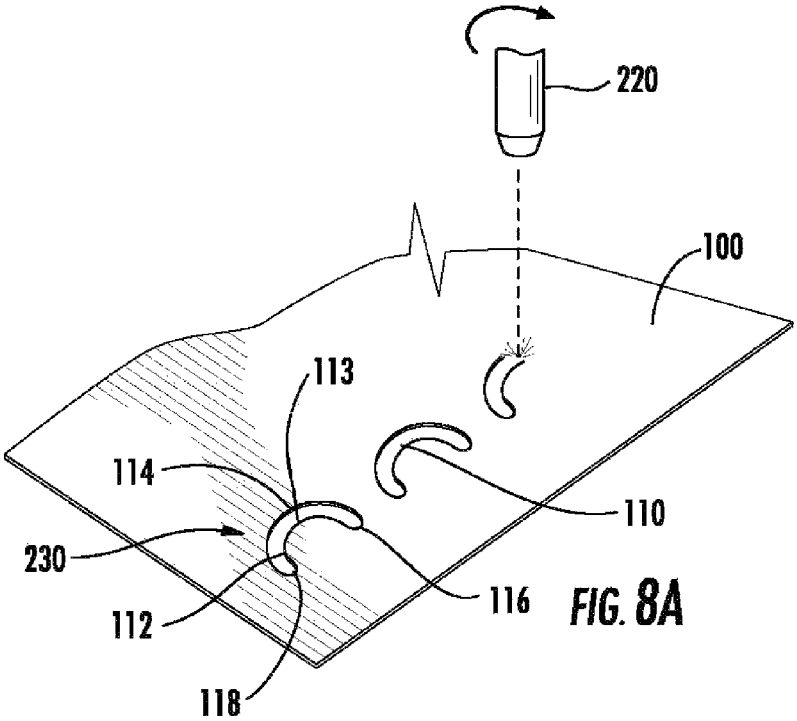
FIG. 8A illustrates a laser cutting an arc in the surface of an article of manufacture in accordance with the present invention.
Figure 8B:
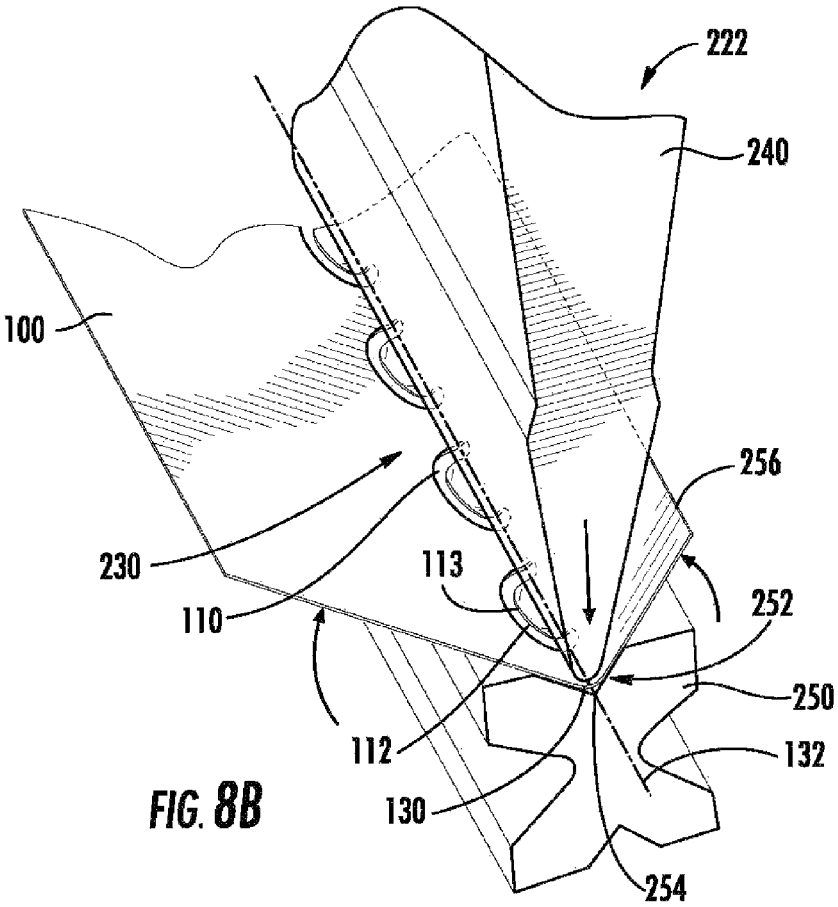
FIG. 8B illustrates a punch and die bending an article of manufacture along an arc that has been cut into the surface thereof in accordance with the present invention.

FIGS. 8A and 8B illustrate the steps involved in a process for making a non-slip surface in an article of manufacture comprising one or more arcuate lugs 120 (shown in FIG. 1A). Specifically, the process for creating the non-slip step 140 (shown in FIG. 2) is illustrated. FIG. 8A illustrates the first step in the process for making the non-slip step 140 (shown in FIG. 2). FIG. 8A illustrates a laser 220 cutting an arc shaped aperture 110 or a series of arc shaped apertures 230 in a surface 100. In the preferred embodiment, the laser 220 cuts the surface 100 in an arc shape and leaves behind an arc shaped aperture 110 having at least an interior arc 112 and an exterior arc 114. The interior arc 112 will eventually become the arcuate lug 120 (shown in FIG. 1A) while the exterior arc 114 will remain relatively unchanged. In the preferred embodiment, the arc shaped aperture 110 is one hundred and eighty (180) degrees by one half inch in radius in the step surface 100 and is repeated every one and one half inch on center along a straight line. The size, position, and orientation of each arcuate lug can vary to suit different conditions. Additionally, each aperture 110 may be independently oriented for optimal performance. This process allows for multiple unique apertures and, ultimately, arcuate lugs to be made in the surface 100. For example, an off-road vehicle in a muddy environment may use a larger arcuate lug with a larger radius or a lug that is raised twice as high as a standard arcuate lug. In the preferred embodiment a laser 220 and a press brake 222 (Shown in FIG. 8B) are used to create arcuate lugs, but arcuate lugs may be created with other machines as well. For example, the surface may be cut with a punch press, turret press, or water jet cutting machine.

FIG. 8B illustrates the second step in the process for making the non-slip surface in an article of manufacture. FIG. 8B illustrates the press brake 222, a punch 240 and a die 250, bending the surface 100 along the secant 132 near an end 116 and an end 118 (both ends shown in FIG. 8A) of the interior arc 112. Placement of the punch 240 and die 250 with respect to the interior arc 112 is important as is the width of the die cavity 252. The position of the interior arc 112 with respect to the bend 130 and the forming die 250 affects the performance or effectiveness of the arcuate lug. Positioning of the surface 100 prior to bending controls the raise and twist of the arcuate lug as does the width of the die cavity 252. In the preferred embodiment, the midpoint 113 of the interior arc 112 crosses the centerline 254 of the die cavity 252 and does not extend beyond the opening of the die cavity 252. In the preferred embodiment, the surface 100 is bent along a secant 132, or line connecting two points on the interior arc 112, perpendicular to the midpoint 113 of the interior arc 112 or center of the aperture 110. During the process of bending the surface 100 along the secant 132 the interior arc 112 will be raised in relation to the surface 100 and the right and left portions 126, 128 (Shown in FIG. 1A) will twist towards the interior of the interior arc 112. It is anticipated that any currently known or future developed means of slicing or cutting an arc in a surface suitable to make the arcuate lug 120 may be used. Additionally, it is anticipated that any currently known or future means of raising and twisting the interior arc 112 may be employed to accomplish this process.

The foregoing embodiments provide advantages over currently available devices. In particular, a non-slip surface created by one or more arcuate lugs and associated features described herein allows for a slippery surface to be more easily gripped or walked upon. The arcuate lug and non-slip surface is especially effective for people going up or down steps. Additionally, the surface may be more easily cleaned and, with the addition of a light source, the surface may be more clearly seen. These advantages reduce the likelihood of slippage and therefore reduce the likelihood of damage caused by said slippage. In addition, these features are created in materials like steel without expensive dedicated tooling which facilitates a quick transition from one surface style to another without a change in tooling and all of the bends may be made on the same tool.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references, including but not limited to, upper, lower, upward, downward, left, right, leftward, rightward, top, bottom, above, below, vertical, and horizontal are only used for identification purposes to aid the reader's understanding of the embodiments of the present invention, and do not create limitations, particularly as to the position, orientation, or use of the invention unless specifically set forth in the claims. Joinder references (e.g., attached, coupled, connected) are to be construed broadly and may include intermediate members between a connection of elements and relative movement between elements. As such, joinder references do not necessarily infer that two elements are directly connected and in fixed relation to each other. In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, and member. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Although the present invention has been described with reference to certain embodiments, persons ordinarily skilled in the art will recognize that changes in detail, form, or structure may be made without departing from the spirit of the invention as defined in the appended claims.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A non-slip surface comprising:

a surface;

said surface having at least one aperture;

said surface having at least one bend along an aperture secant perpendicular to a line connecting the center of said aperture and said aperture secant; and at least one lug within said surface along said bend, wherein said lug comprises a raised center portion, a raised and inwardly twisted right portion, and a raised and inwardly twisted left portion.

2. The non-slip surface of claim 1, wherein said lug is an arcuate lug.

3. The non-slip surface of claim 2, wherein said raised center portion and said raised and twisted right and left portions of said arcuate lug are blunt.

4. The non-slip surface of claim 2, wherein said aperture is an arc-shaped aperture ranging from 30 degrees to 270 degrees.

5. The non-slip surface of claim 2, wherein said bend is approximately 90 degrees.

6. The non-slip surface of claim 2, further comprising a plurality of said arcuate lugs in said surface.

7. The non-slip surface of claim 2, wherein said surface comprises the surface of a step.

8. The non-slip surface of claim 2, wherein said surface comprises the surface of a tile.

9. The non-slip surface of claim 2, wherein said surface comprises the surface of a handle.

10. The non-slip surface of claim 2, wherein a light source emits light through said aperture.

11. A non-slip surface edge comprising:

a surface;

said surface having at least one edge;

said surface edge having at least one aperture;

said surface edge having at least one bend along an aperture secant perpendicular to a line connecting the center of said aperture and said aperture secant; and a plurality of arcuate lugs within said surface along said edge, wherein each of said arcuate lugs comprises a raised center portion, a raised and inwardly twisted right portion, and a raised and inwardly twisted left portion.

12. The non-slip surface edge of claim 11, wherein said surface comprises the surface of a step.

13. An arcuate lug on a non-slip surface comprising:

a raised section of said non-slip surface having a center portion, a right portion, and a left portion; and said right and left portions twisted inwardly toward each other.

14. A process of creating a non-slip surface in an article of manufacture comprising the steps of:

cutting at least one aperture into a surface of said article, wherein said aperture creates at least one interior arc in said surface having a center, a right and a left portion; and raising said center portion of said interior arc and raising and twisting said right and left portions of said interior arc in relation to said surface by bending said surface along a secant perpendicular to a line connecting the midpoint of said arc and said secant, creating at least one arcuate lug in said surface.

15. The process of claim 14, wherein said aperture is cut by a laser.

16. The process of claim 14, wherein a plurality of apertures are cut in said surface along a straight line.

17. The process of claim 16, wherein the center of said plurality of apertures are positioned approximately every one and one half inch along said line.

18. The process of claim 14, wherein said raised center portion and said raised and twisted right and left portions of said arcuate lug are blunt.

19. The process of claim 14, wherein said interior arc ranges from 30 degrees to 270 degrees.

20. The process of claim 14, wherein said bend is approximately 90 degrees.

21. The process of claim 14, wherein said article of manufacture is at least one step.

22. The process of claim 14, wherein multiple different apertures are cut into said surface.

23. The process of claim 14, further comprising the step of independently orienting said surface prior to cutting each aperture.

* * * * *